US011299848B2

(12) United States Patent
Johnson

(10) Patent No.: US 11,299,848 B2
(45) Date of Patent: Apr. 12, 2022

(54) HOT IRON COVERING ASSEMBLY

(71) Applicant: Ty Johnson, Union City, CA (US)

(72) Inventor: Ty Johnson, Union City, CA (US)

( * ) Notice: Subject to any disclaimer, the term of this patent is extended or adjusted under 35 U.S.C. 154(b) by 15 days.

(21) Appl. No.: 16/904,134

(22) Filed: Jun. 17, 2020

(65) Prior Publication Data

US 2021/0395942 A1 Dec. 23, 2021

(51) Int. Cl.
*D06F 83/00* (2006.01)

(52) U.S. Cl.
CPC ..... *D06F 83/00* (2013.01)

(58) Field of Classification Search
CPC ..... D06F 83/00; D06F 75/40; D06F 75/79; D06F 75/02
See application file for complete search history.

(56) References Cited

U.S. PATENT DOCUMENTS 626,286 A 6/1899 Miller
2,750,697 A * 6/1956 Jacobson ..... D06F 75/38 38/97
2,778,589 A * 1/1957 Peterson ..... D06F 79/02 248/117.3
3,257,746 A * 6/1966 Cohen ..... D06F 75/38 38/97
4,660,307 A 4/1987 Fay
5,582,374 A * 12/1996 Fung ..... D06F 79/02 248/117.2
D396,915 S 8/1998 McIntyre
5,966,851 A 10/1999 Serpa
6,226,904 B1 5/2001 Brady
8,375,612 B2 2/2013 Talip
8,794,826 B2 * 8/2014 Tracy ..... D06F 79/06 374/141
2002/0036000 A1 3/2002 Hirata
2008/0313936 A1 * 12/2008 Ho ..... D06F 75/38 38/81
2010/0024257 A1 2/2010 Adams
2020/0018014 A1 * 1/2020 Alipour ..... D06F 75/38

* cited by examiner

*Primary Examiner* — Ismael Izaguirre

(57) ABSTRACT

A hot iron covering assembly includes a panel that has a top side, a bottom side and a perimeter edge. The top side has a size and shape of a base of an iron. The panel comprises a flexible and heat resistant material. A securing member is configured to releasably secure the panel to the base of the iron.

7 Claims, 4 Drawing Sheets

HOT IRON COVERING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hot object protective covering and more particularly pertains to a new hot object protective covering for an iron to prevent injuries from burns caused by a base of heated iron.

(2) Description of Related Art Including Information Disclosed Under 37 CFR 1.97 and 1.98

The prior art relates to hot object protective coverings used to prevent accidental burns.

BRIEF SUMMARY OF THE INVENTION

An embodiment of the disclosure meets the needs presented above by generally comprising a panel that has a top side, a bottom side and a perimeter edge. The top side has a size and shape of a base of an iron. The panel comprises a flexible and heat resistant material. A securing member is configured to releasably secure the panel to the base of the iron.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
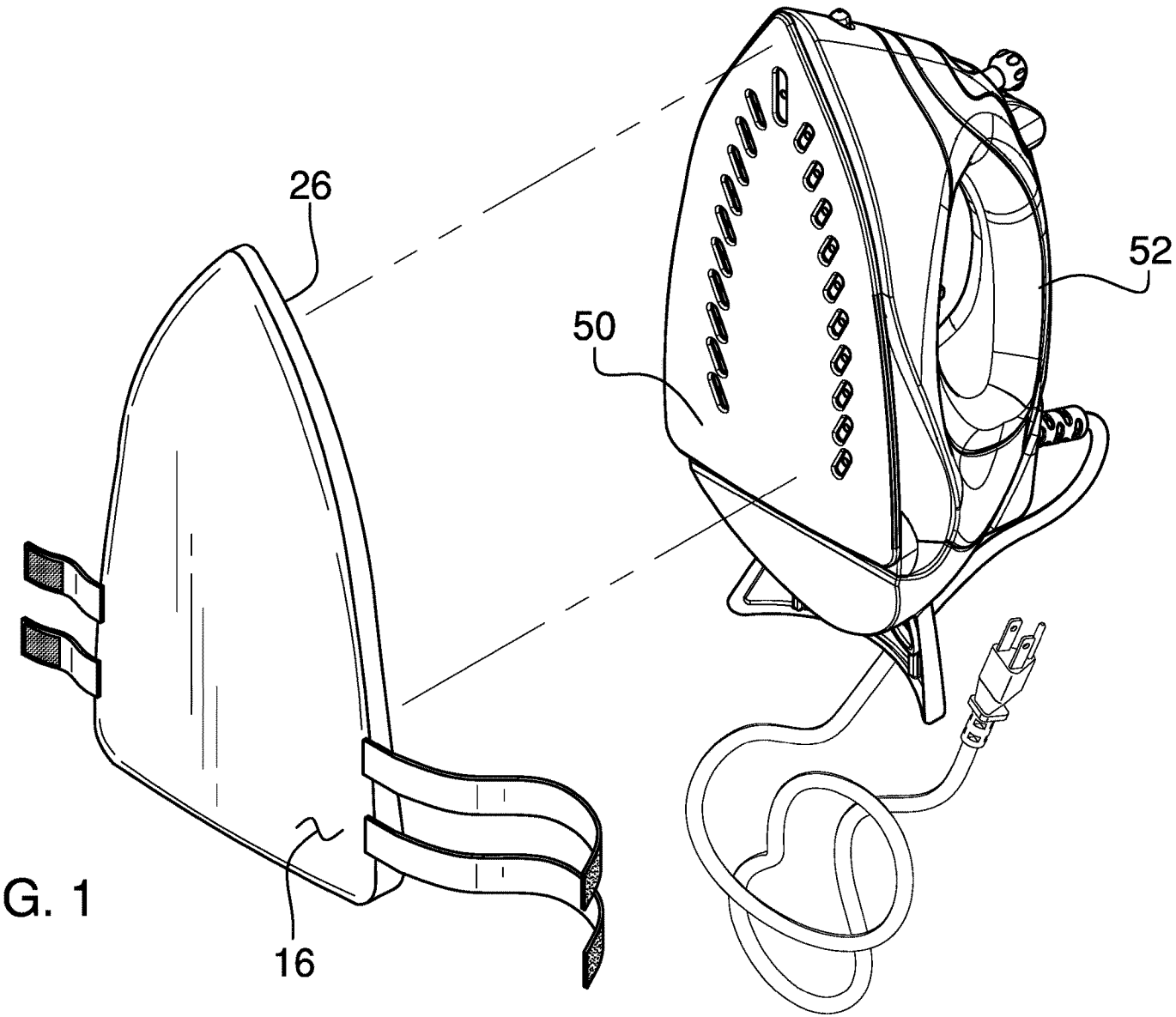
FIG. 1 is a bottom isometric view of a hot iron covering assembly according to an embodiment of the disclosure.
Figure 2:
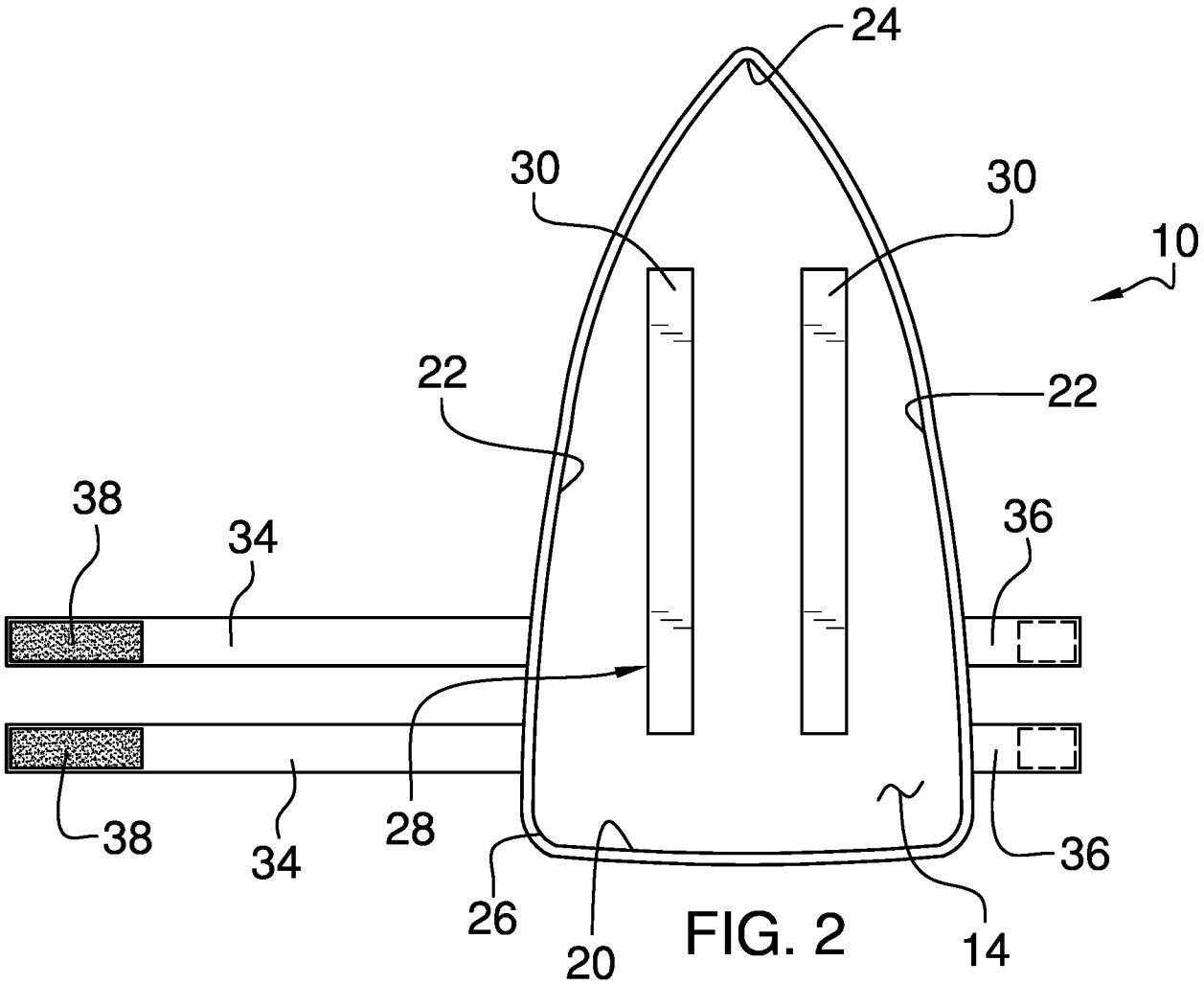
FIG. 2 is a top view of an embodiment of the disclosure.
Figure 3:
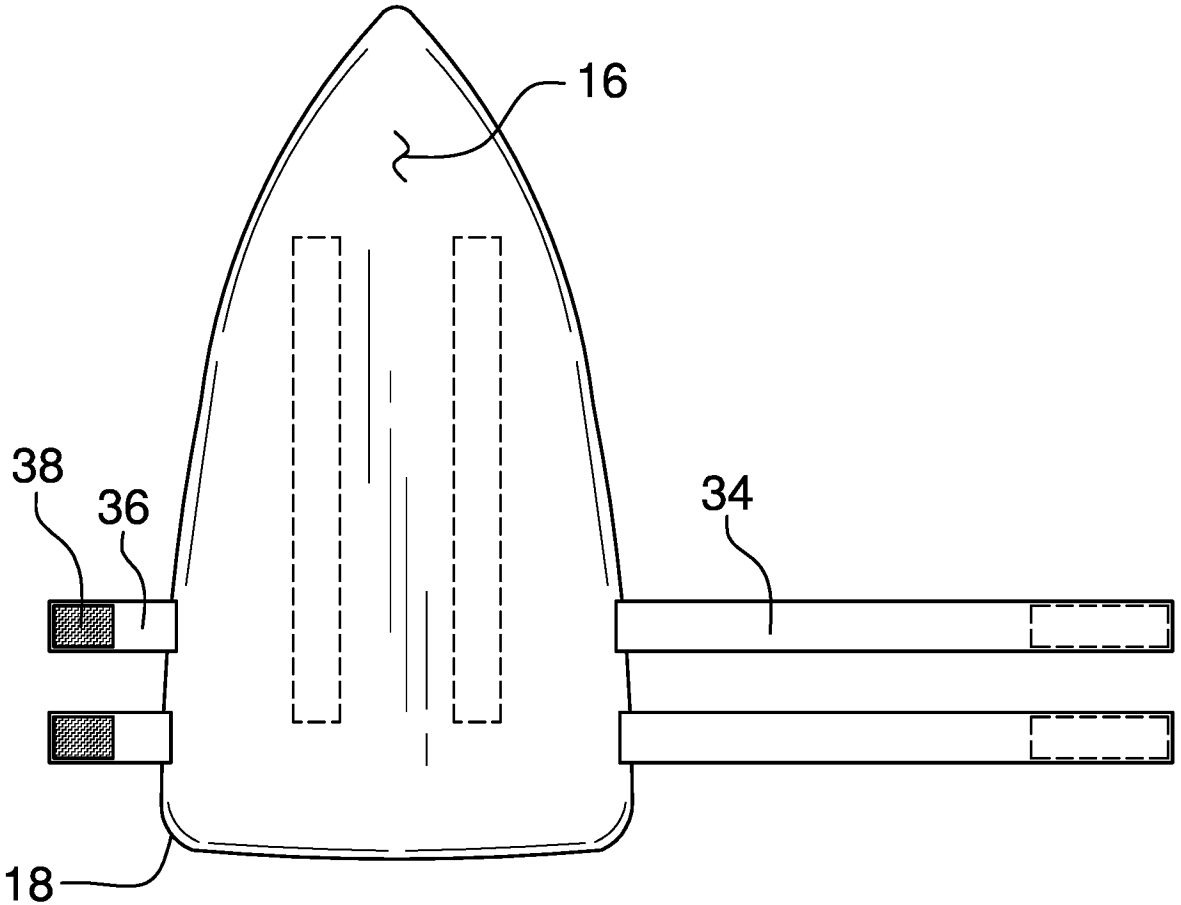
FIG. 3 is a bottom view of an embodiment of the disclosure.
Figure 4:
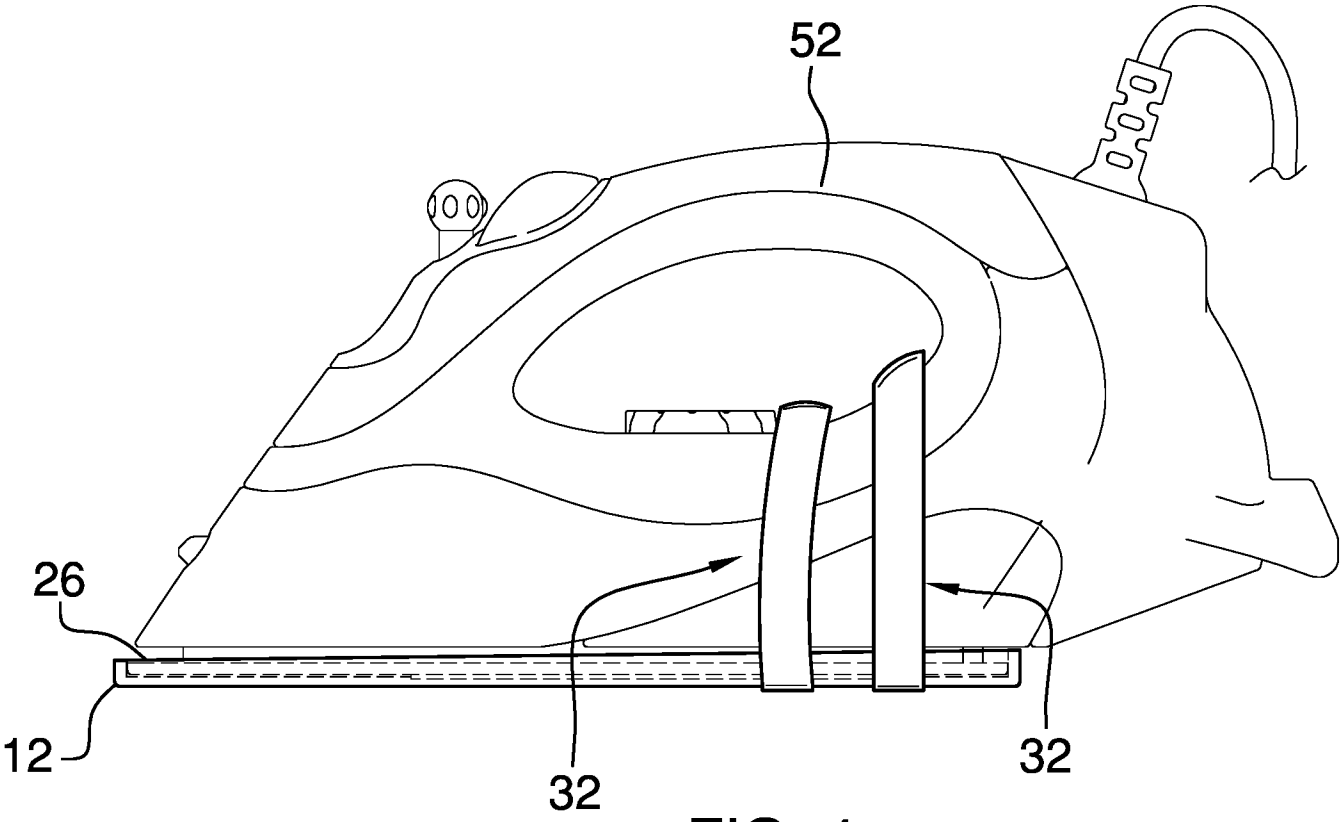
FIG. 4 is a side in-use view of an embodiment of the disclosure.

With reference now to the drawings, and in particular to FIGS. 1 through 4 thereof, a new hot object protective covering embodying the principles and concepts of an embodiment of the disclosure and generally designated by the reference numeral 10 will be described.

As best illustrated in FIGS. 1 through 4, the hot iron covering assembly 10 generally comprises a panel 12 that has a top side 14, a bottom side 16 and a perimeter edge 18. The top side 14 has a size and shape of a base 50 of a conventional iron 52. Thus, it would typically include a straight rear edge 20, a pair of lateral edges 22 that come to a pointed front edge 24.

A perimeter lip 26 is attached and is coextensive with the perimeter edge 18. The perimeter lip 26 extends upwardly from the panel 12. The perimeter lip 26 and the panel 12 will typically comprise a unitary structure. The panel 12 comprises a flexible and heat resistant material. One material in particular which may be used is a silicone material. Silicone is heat resistant to a temperature which is much higher than is achieved by a conventional iron.

A securing member 28 is configured to releasably secure the panel 12 to the base 50 of the iron 52. In one embodiment, the securing member 28 includes a magnet 30 that is mounted in the panel 12. The magnet 30 may be positioned in the surface of the top side 14 or may be embedded between the top 14 and bottom 16 sides. The magnet 30 is magnetically attracted to the base 50 of the iron 52. As can be seen in the Figures, the magnet 30 may include multiple magnets 30. In another embodiment, the securing member 28 comprises a strap 32 that is attached to the panel 12. The strap 32 is configured to be extended around the iron 52 to secure the panel 12 to the iron 52. More particularly, the strap 32 may include a first section 34 attached to the panel 12 and a second section 36 attached to the panel 12. The first 34 and second 36 sections are securable to each other a hook and loop coupler 38. The strap 32 may include a pair of straps 32.

In use, after the iron 52 has been used and has an elevated temperature, the panel 12 is placed on the base 50 of the iron 52 to cover the base 50 and prevent the base 50 from inadvertently burning a person or burning/melting another object.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hot iron covering assembly comprising:

a panel having a top side, a bottom side and a perimeter edge, the top side having a size and shape of a base of an iron;

the panel comprising a flexible and heat resistant material; and a securing member being configured to releasably secure the panel to the base of the iron, wherein the securing member includes a magnet being mounted in the panel, the magnet being magnetically attracted to the base of the iron.

2. The hot iron covering assembly according to claim 1, further including a perimeter lip being attached to and being coextensive with the perimeter edge, the perimeter lip extending upwardly from the panel.

3. The hot iron covering assembly according to claim 2, wherein the perimeter lip and the panel comprise a unitary structure.

4. The hot iron covering assembly according to claim 1, wherein the panel comprises a silicone material.

5. The hot iron covering assembly according to claim 1, wherein the securing member includes a strap being attached to the panel, the strap being configured to be extended around the iron to secure the panel to the iron.

6. The hot iron covering assembly according to claim 1, wherein the securing member includes a strap being attached to the panel, the strap being configured to be extended around the iron to secure the panel to the iron.

7. A hot iron covering assembly comprising:

a panel having a top side, a bottom side and a perimeter edge, the top side having a size and shape of a base of an iron, a perimeter lip being attached to and being coextensive with the perimeter edge, the perimeter lip extending upwardly from the panel, the perimeter lip and the panel comprising a unitary structure;

the panel comprising a flexible and heat resistant material, the panel comprising a silicone material;

a securing member being configured to releasably secure the panel to the base of the iron, the securing member including:

a magnet being mounted in the panel, the magnet being magnetically attracted to the base of the iron; and a strap being attached to the panel, the strap being configured to be extended around the iron to secure the panel to the iron.

* * * * *